US006238143B1

(12) United States Patent
Zablonski

(10) Patent No.: US 6,238,143 B1
(45) Date of Patent: May 29, 2001

(54) GROUND ANCHOR

(76) Inventor: Alan Zablonski, Route 7A, Box 591, Sheffield, MA (US) 01257

( * ) Notice: Subject to any disclaimer, the term of this patent is extended or adjusted under 35 U.S.C. 154(b) by 0 days.

(21) Appl. No.: 09/411,816

(22) Filed: Oct. 1, 1999

(51) Int. Cl.[7] ..... E02D 5/80
(52) U.S. Cl. ..... 405/259.1; 52/163
(58) Field of Search ..... 405/172, 244, 405/259.1; 52/162–166

(56) References Cited

U.S. PATENT DOCUMENTS

| | | | |
|---|---|---|---|
| 4,574,539 | 3/1986 | Deike | 52/163 |
| 4,611,446 | 9/1986 | Beavers et al. | 52/163 |
| 4,688,360 | 8/1987 | Luong et al. | 52/166 |
| 4,738,063 | 4/1988 | Alsop | 52/163 |
| 4,993,870 | 2/1991 | Bridgewater | 405/21 |
| 5,123,779 | 6/1992 | Miller | 405/19 |
| 5,171,108 | 12/1992 | Hugron | 405/259.1 |
| 5,175,966 | 1/1993 | Remke et al. | 52/163 |
| 5,625,984 * | 5/1997 | Chapman et al. | 405/259.1 X |

* cited by examiner

*Primary Examiner*—David Bagnell
*Assistant Examiner*—Tara L. Mayo
(74) *Attorney, Agent, or Firm*—Malcolm J. Chisholm, Jr.

(57) ABSTRACT

The invention is an improved ground anchor for securing an anchor cable to the ground. The ground anchor includes a body having a cable mount surface and an opposed drive rod surface, and a drive end defining a curled tip with a guide end opposed to the drive end defining first and second guide forks. An anchor cable mount projects from the cable mount surface of the body about midway between the drive and guide ends. The curled tip defines a guide bore, the first and second guide forks define a drive rod slot, and the curled tip and guide forks extend from the drive rod surface in the same or first direction so that a drive rod may pass through the drive rod slot into the guide bore. The anchor cable mount extends away from the cable mount surface in a second direction opposed to the first direction so that the cable mount does not interfere with the drive rod passing through the drive rod slot and guide bore. In alternative embodiments of the present ground anchor, the drive end or guide end of the body define extraction cable mounts dimensioned to receive an extraction cable. The guide bore and drive rod slot provide for use of any drive rod narrow enough to rest in the drive rod slot and having a pointed tip that engages but does not pass through the guide bore.

14 Claims, 7 Drawing Sheets

GROUND ANCHOR

TECHNICAL FIELD

The present invention relates to devices for securing objects and especially relates to a ground anchor for securing an anchor cable to the ground for supporting landscaping materials such as a tree.

BACKGROUND OF THE INVENTION

Ground anchors are well known and widely used in landscaping operations, for example to anchor a transplanted tree in an upright position during a period of time following transplantation until the roots of the tree grow to suitably anchor the tree without need for additional support. In such a role, a generally planar, elongate ground anchor is typically secured to an anchor cable and driven into the ground by a driving rod or tool so that the cable remains above the ground, and the ground anchor is in an insertion position basically parallel to a direction the anchor was driven into the ground. The ground anchor often has a curved or slanted top end, and when the anchor cable is pulled upward, away from the ground, the ground anchor moves to an anchor position, wherein the anchor is essentially perpendicular to the direction the anchor was driven into the ground, thereby securing the cable against further movement away from the ground. A support rope or line may then be secured between the anchor cable and the tree to secure the tree.

Modern ground anchors have been designed to minimize manufacturing costs while achieving adequate performance. For example, in U.S. Pat. No. 5,171,108 to Hugron, a ground anchor is disclosed that includes a curled leading or drive end having a throat that receives a specialized tip of a drive rod to position the anchor under ground. Hugron also includes a cable passing through the anchor to form a loop above the throat so that the drive rod may pass through the loop and then into the throat. Securing the rod along the anchor within the loop of the cable restricts the anchor from moving out of a desired alignment in the event the anchor impacts a rock as it is driven into the ground. However, because the anchor of Hugron must have the cable loop to guide the drive rod, the anchor is limited to a cable with adequate rigidity to form the loop, and the loop must be secured in a fixed position and of proper size to receive the drive rod. Consequently, a heavy cable must be used, and a simple single-strand wire secured by a common knot or tight winding to the anchor body may not be used. Additionally, Hugron shows a curled top end that curls away from a central body of the anchor in a direction opposed to a direction of curvature of the rod receiving throat. Therefore, as the ground anchor is pulled from the insertion position to the anchor position, the curled throat resists such movement to an alignment transverse to the direction of insertion, and may actually prevent movement to a full anchor position. Accordingly, while the ground anchor of Hugron is essentially a single-piece construction of modest cost, it has the aforesaid limitations inherent to its structure.

A somewhat similar ground anchor is shown in U.S. Pat. No. 5,123,799 to Miller, wherein a tail flap extends away from a body of the anchor to position the anchor in the anchor position when an anchor strap is pulled. While an offset drive rod receiving socket in Miller is positioned to extend away from the body of the anchor in the same direction as the tail flap and hence does not interfere with movement of the anchor from the insertion to the anchor position, the socket is nonetheless a complicated structure that must be welded, or otherwise secured offset to a center line of the body of the anchor. Therefore, the ground anchor of Miller necessarily involves substantial manufacturing costs. A further example of an even more complicated ground anchor is shown in U.S. Pat. No. 5,175,966 to Remke et al., wherein a stepped drive rod receiving notch in a top or guide end of the anchor is positioned between two planing wings that direct the anchor after insertion into the anchor position. Instead of having the drive rod pass to a drive end of the anchor as in Hugron and Miller, the specialized drive rod of Remke et al. includes a "U"-shaped groove for engaging three bearing edges of the anchor at the guide or top end in order to keep the anchor in coaxial alignment with the drive rod during insertion into the ground. While efficient, the complications of requiring three mating edges between the anchor and rod along with a need for the anchor body to be adequately strong to avoid deflection during insertion into the ground necessarily increase manufacturing costs.

Additionally, known ground anchors such as those described provide the user little or no opportunity to extract the anchor after use, without bending the anchor or breaking the attachment structure that secures the anchor cable to the ground anchor. Accordingly, there is a need for a ground anchor that is of simple construction, yet of durable application, and that may be re-used in specific instances.

DISCLOSURE OF THE INVENTION

An improved ground anchor is disclosed for securing an anchor cable to the ground. The ground anchor includes a body having a cable mount surface and an opposed drive rod surface, and a drive end defining a curled tip with a guide end opposed to the drive end defining first and second guide forks. An anchor cable mount projects from the cable mount surface of the body about midway between the drive and guide ends. The curled tip defines a guide bore, the first and second guide forks define a drive rod slot, and the curled tip and guide forks extend from the drive rod surface in a first direction so that a drive rod may pass through the drive rod slot into the guide bore. The anchor cable mount extends away from the cable mount surface in a second direction opposed to the first direction so that the cable mount does not interfere with the drive rod passing through the drive rod slot and guide bore.

In a first alternative embodiment of the present ground anchor, the drive end of the body defines a drive extraction cable mount dimensioned to receive an extraction cable, and in a second alternative embodiment, the guide end defines a guide extraction cable mount. In use of the improved ground anchor of the present invention, a user simply attaches a wire or cable anchor cable to the anchor cable mount, and then secures a drive rod in the guide bore so that the rod also lies within the drive rod slot between the first and second guide forks. For example, one of the user's hands could simply hold the drive rod in that position while the user's other hand swings a hammer or mallet to force the drive rod into the ground. After the ground anchor passes into the ground, the ground will secure the anchor and drive rod adjacent each other so that the drive rod slot and guide bore restrict the anchor from moving out of coaxial alignment with the drive rod. When the drive rod has inserted the ground anchor a suitable depth, the user then pulls the anchor cable away from the ground to move the anchor from an insertion position to an anchor position. Because the curled tip and guide forks extend from the drive surface of the anchor body in the same direction, the curled tip does not interfere with movement of the anchor into the anchor position. When it is desired to re-use the ground anchor, an extraction cable is secured to the drive or guide extraction cable mount prior to insertion of the ground anchor into the ground; the anchor is inserted and pulled to the anchor position leaving a grab section of the extraction cable above the ground; and after usage is completed, the user simply pulls the grab section of the extraction cable to pivot the anchor back to a position coaxial with the direction of insertion, and then continues to pull the extraction cable to extract the anchor for re-use.

Accordingly, it is a general object of the present invention to provide an improved ground anchor that overcomes deficiencies of prior art ground anchors.

It is a more specific object to provide an improved ground anchor that minimizes manufacturing costs.

It is yet another specific object to provide an improved ground anchor that can be inserted into the ground with a drive rod that may be a common tool used for various purposes.

It is still a further object to provide an improved ground anchor that facilitates extraction of the anchor after usage with minimal risk of damage to the anchor.

These and other objects and advantages of this invention will become more readily apparent when the following description is read in conjunction with the accompanying drawings.

DESCRIPTION OF THE PREFERRED EMBODIMENTS

Figure 1:
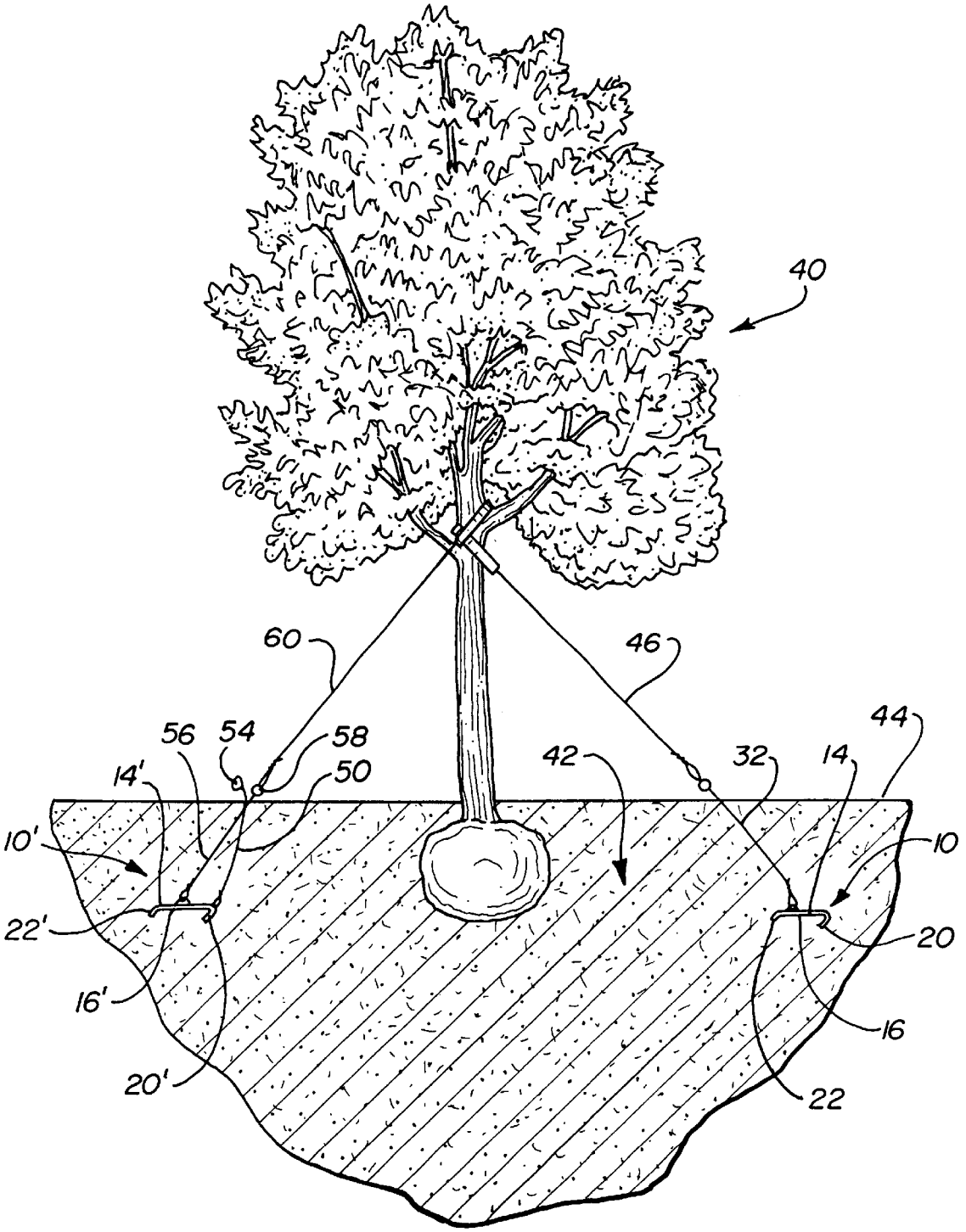
FIG. 1 is a partial cross-section view of a transplanted tree and its underground root ball being supported by alternative embodiments of ground anchors constructed in accordance with the present invention.
Figure 2:
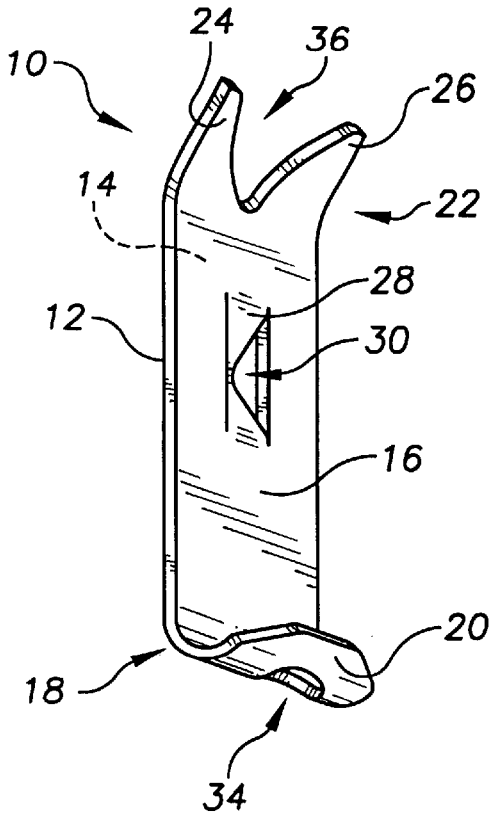
FIG. 2 is a perspective view of a ground anchor of the present invention.
Figure 3:
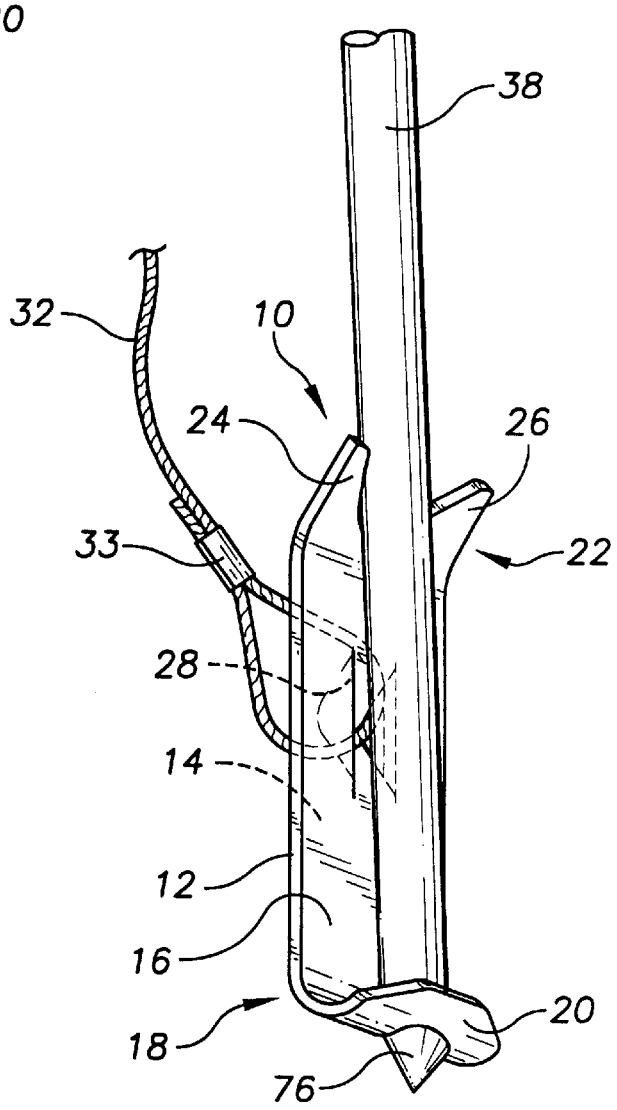
FIG. 3 is a perspective view of the FIG. 2 ground anchor, showing an anchor cable secured to the anchor, and a drive rod within a guide bore and drive rod slot of the anchor.

Referring to the drawings in detail, a ground anchor of the present invention is shown and generally designated by the reference numeral 10. As shown in FIGS. 1, 2 and 3 the ground anchor includes a body 12 having a cable mount surface 14, an opposed drive rod surface 16, a drive end 18 defining a curled tip 20, and a guide end 22 opposed to the drive end 18 defining a first guide fork 24 and a second guide fork 26. An anchor cable mount 28 projects from the cable mount surface 14 of the body 12 about midway between the drive end 18 and the guide end 22. The anchor cable mount 28 defines a mount slot 30 that is dimensioned to receive an anchor cable 32 so that the anchor cable 32 is secured to the ground anchor 10. The anchor cable 32 may be secured to the mount 28 by a standard cable clamp 33 or standard knot (not shown). The curled tip 20 defines a guide bore 34 and the first and second guide forks 24, 26 define a drive rod slot 36 between the forks 24, 26. The curled tip 20 and first and second guide forks 24, 26 all extend away from the drive rod surface 16 in a first direction so that a straight drive rod 38 (shown in FIG. 3) may pass through the drive rod slot 36 and into the guide bore 34. The anchor cable mount 28 extends away from the cable mount surface 14 of the body 12 in a second direction that is opposed to the first direction, so that the cable mount 28 does not interfere with the drive rod 38 passing through or resting simultaneously within the drive rod slot 36 and guide bore 34.

As shown in FIG. 1, the ground anchor 10 may be used to assist in support of a transplanted tree 40, wherein the ground anchor 10 is secured underground 42 so that the anchor cable 32 remains above a ground surface 44. A rope or line 46 is then secured to the anchor cable 32 and the tree 40 in a manner well known in the art, and it is also well known to use at least three such ground anchors 10 positioned around the tree 40 in order to properly secure the transplanted tree 40. The ground anchor 10 shown in FIG. 1 is shown in an anchor position, wherein the anchor 10 is approximately transverse or perpendicular to a direction of insertion of the ground anchor 10 from the ground surface 44 to a suitably deep underground 42 position. As discussed in more detail below, the anchor position is achieved when a user (not shown) of the ground anchor pulls the anchor cable 32 away from the ground surface 44 after inserting the anchor 10 underground. Because the curled tip 20 and guide forks 24, 26 extend away from the drive rod surface 16 of the body 12 in the same or first direction, the curled tip 20 does not interfere with movement of the anchor cable 10 into the anchor position from an insertion position coaxial with a direction of insertion of the anchor 10 underground 42. Additionally, because the anchor cable mount 28 projects away from the cable mount surface 14 in a direction opposed to a direction of extension of the curled tip 20 and first and second guide forks 24, 26, the anchor cable mount 28 is unimpeded by the curled tip 20 or first and second guide forks 24, 26 as the ground anchor 10 moves from the insertion position to the anchor position, thereby further assisting movement of the ground anchor into the anchor position.

Figure 4:
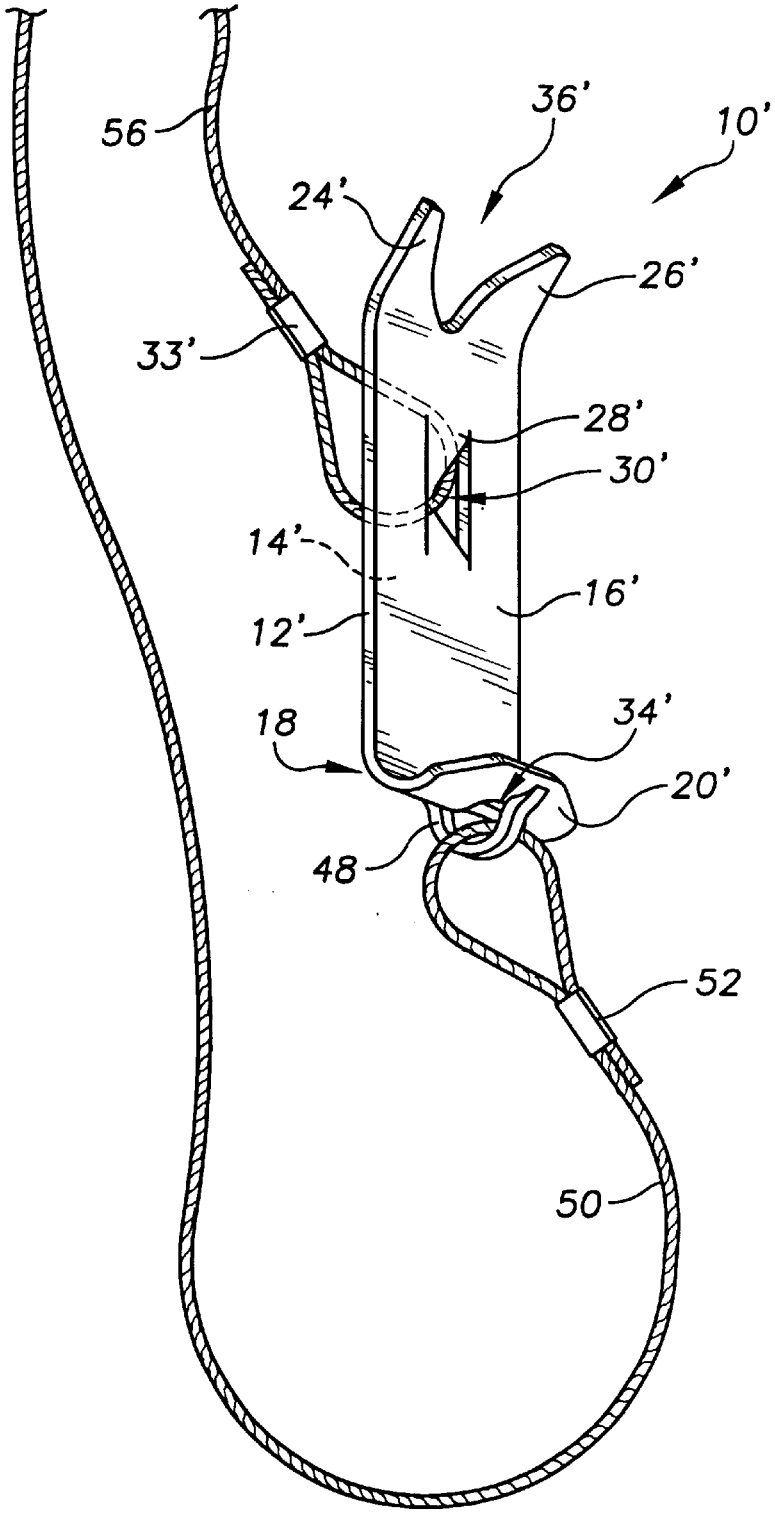
FIG. 4 is a perspective view of a first alternative embodiment of the ground anchor of the present invention, showing a drive extraction cable mount defined within a drive end of the ground anchor, and showing an extraction cable secured to the drive extraction cable mount, and an anchor cable secured to an anchor cable mount of the ground anchor.

A first alternative embodiment of the ground anchor 10' is best shown in FIG. 4, and also shown as used in FIG. 1, and is referred to herein also as a first extraction ground anchor 10'. (For purposes of efficiency, components of the first alternative embodiment of the ground anchor 10' that are identical to components of the ground anchor 10 shown in FIGS. 1, 2 and 3, will be referred to herein and identified in FIGS. 1 and 4 as primes of the reference numerals of the identical components of the ground anchor 10, and those components that are identical will not be described again, as they have been described above. For example, a drive rod surface of the first alternative embodiment of the ground anchor 10' has the reference numeral 16' in FIGS. 1 and 4.) In the first extraction ground anchor 10', a drive end 18' of the body 12' defines a drive extraction cable mount 48 dimensioned to receive an extraction cable 50 that may be secured by way of a standard second cable clamp 52 or knot (not shown). As shown in FIG. 1, the extraction cable 50 includes a grab loop section 54 dimensioned to remain above the surface 44 of the ground when the first extraction ground anchor 10' is positioned underground 42 by the user.

In use of the extraction cable 50 with a second anchor cable 56, the extraction cable is dimensioned so that the grab loop section 54 is positioned near a line attachment end 58 of the second anchor cable 56 in order to facilitate insertion and subsequent extraction of the first extraction ground anchor 10'. After the anchor 10' is inserted under ground 42, the user (not shown) pulls the second anchor cable 56 to move the anchor 10' from an insertion position to an anchor position shown in FIG. 1, and then attaches a second rope or line 60 between the line attachment end 58 of the second anchor cable 57 and the tree 40. When it is desired to extract the first extraction ground anchor 10', the user simply grabs the grab loop section 54 (by hand or with a tool depending upon the size of the anchor 10', and shear resistance of the underground area 42), and pulls the grab section 54 away from the ground surface 44 to extract the anchor 10', for re-use.

Figure 5:
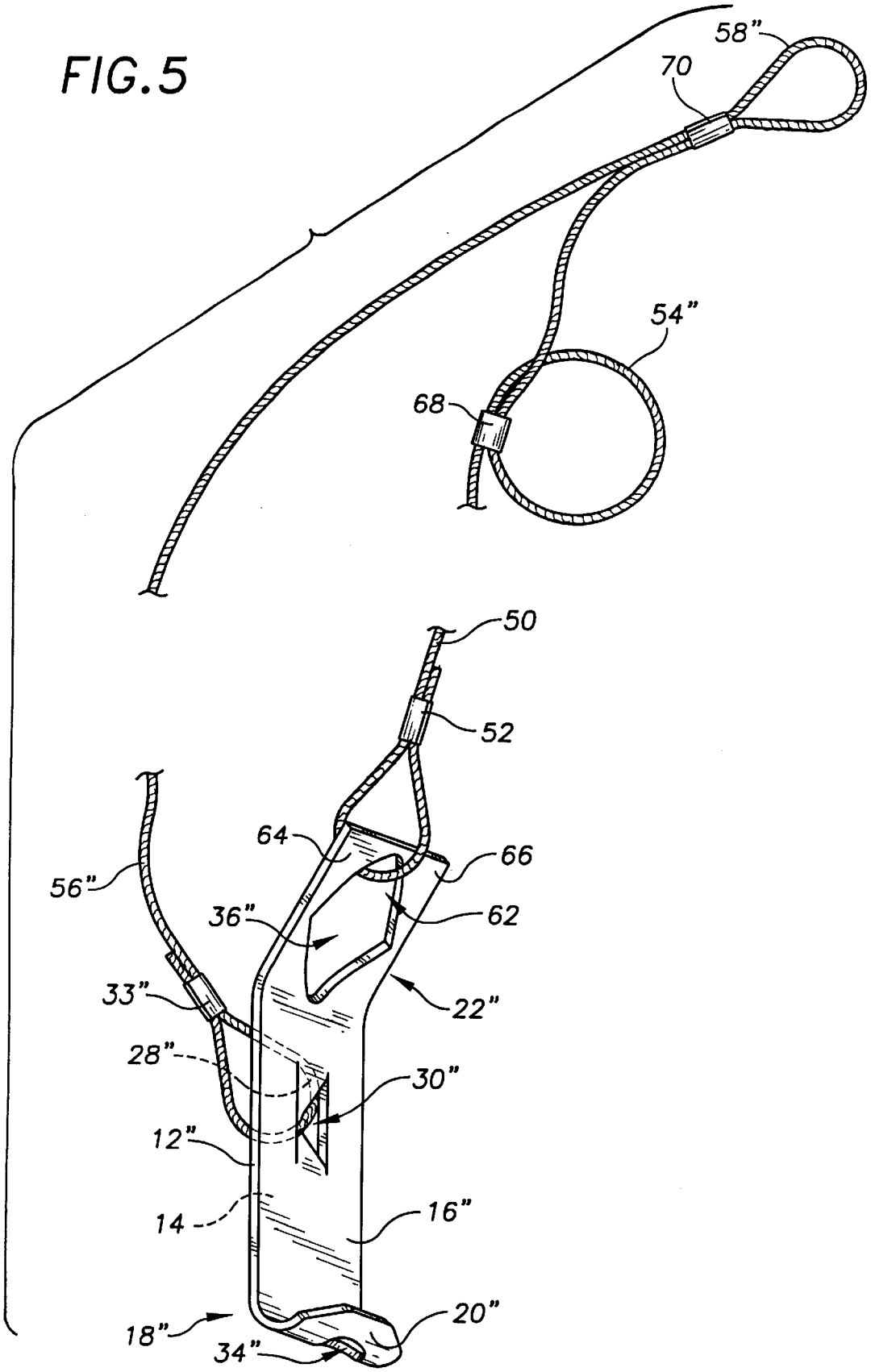
FIG. 5 is a perspective view of a second alternative embodiment of the ground anchor of the present invention, showing a guide extraction cable mount defined within a guide end of the anchor, and showing an extraction cable secured to the guide extraction cable mount, and showing an anchor cable secured to an anchor cable mount of the ground anchor.

A second alternative embodiment of the ground anchor 10", or second extraction ground anchor 10" is shown in FIGS. 5–8. (For purposes of convenience, components of the second extraction ground anchor 10" that are identical to components of the ground anchor 10 shown in FIGS. 2 and 3 will be described in FIGS. 5–8 and referred to with double primes of the reference numerals of the ground anchor 10. For example, the drive rod surface of the second extraction ground anchor 10" in FIGS. 5–8 is designated by the reference numeral 16".) In the second extraction ground anchor 10", a guide end 22" defines a guide extraction cable mount 62 dimensioned to receive an extraction cable 50", which, as described above, may be secured thereto by a standard cable clamp 52" or knot (not shown). As shown in FIG. 5, the guide extraction cable mount 62 in the guide end 22" may be defined by a first extraction guide fork 64 and a second extraction guide fork 66 merged together to define the guide extraction cable mount 62, wherein the first and second extraction guide forks extend away from a drive rod surface 16" in the same or first direction and an anchor cable mount 28" extends away from a cable mount surface 14" in a second direction opposed to the first direction.

While the first and second extraction ground anchors 10', 10" have been described in detail for ease of understanding specific alternative structures, it is to be understood that the present ground anchor 10 invention includes extraction cable mount means for securing an extraction cable 50 to the ground anchor 10, such as the aforesaid drive extraction cable mount 48 and the guide extraction cable mount 62. The extraction cable mount means may also includes any standard cable or line securing structure that can be secured to or defined in either or in both the guide end 22 and/or the drive end 18 of the ground anchor 10.

FIG. 5 shows the second extraction ground anchor 10" with a single cable forming both the anchor cable 56" and the extraction cable 50, wherein the grab section 54 of the extraction cable 50 is formed by a third cable clamp 68 forming a loop in the extraction cable 50, and the line attachment end 58" is formed by a fourth cable clamp 70 securing the extraction cable 50 to the anchor cable 56". Such a joined anchor 56" and extraction cable 50 provides substantial economy of manufacture and ease of application of the ground anchor 10 with an extraction cable mount means.

Figure 6:
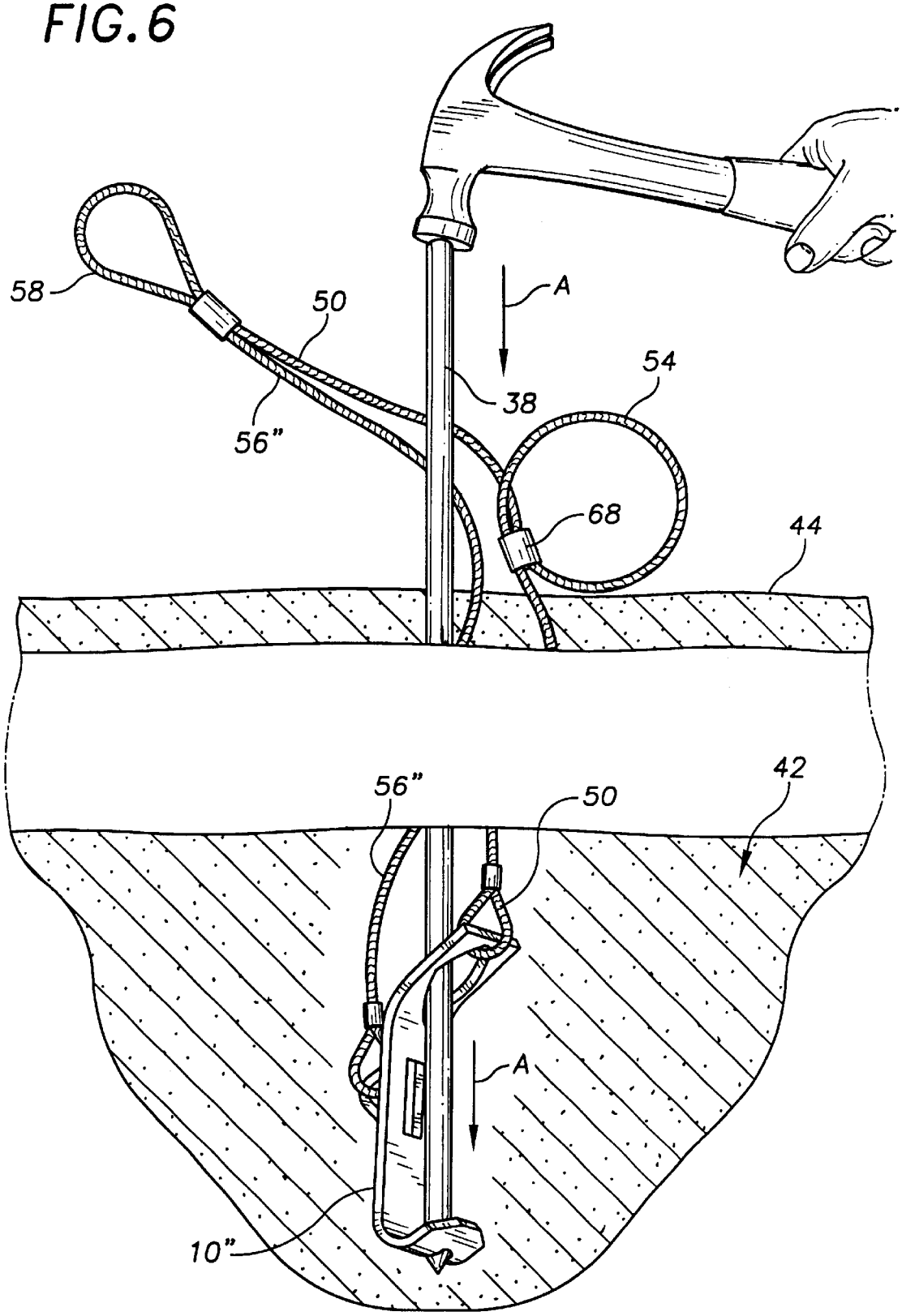
FIG. 6 is a partial cross-section view of the ground, showing in perspective the FIG. 5 second alternative embodiment of the ground anchor being driven into an insertion position in the ground by a drive rod.
Figure 7:
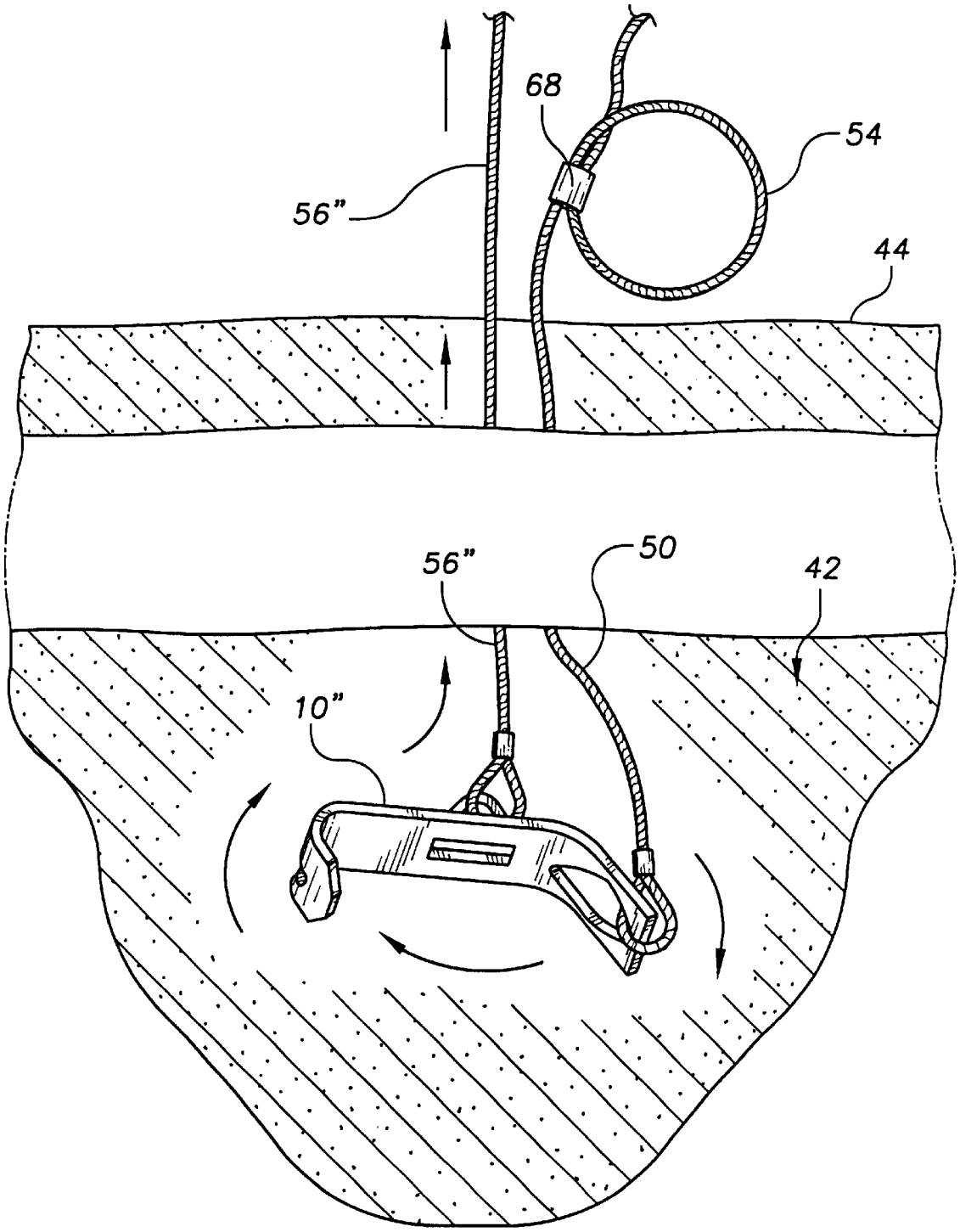
FIG. 7 is a partial cross-section view of the ground, showing in perspective the FIG. 5 second alternative embodiment of the ground anchor being pulled by the anchor cable into an anchor position.
Figure 8:
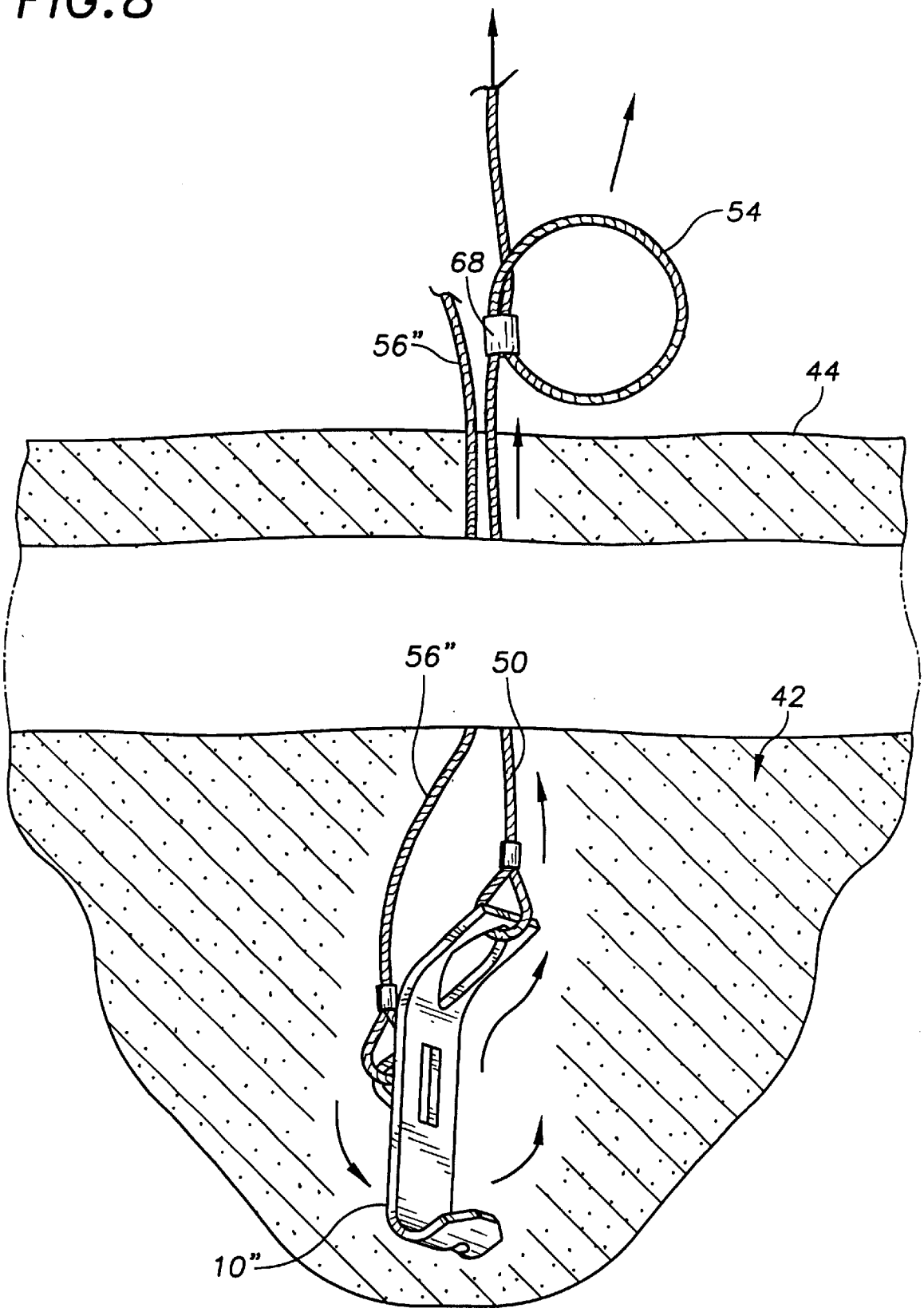
FIG. 8 is a partial cross-section view of the ground, showing in perspective the FIG. 5 second alternative embodiment of the ground anchor being pulled by the extraction cable into the insertion position for extraction of the anchor from the ground.

FIGS. 6–8 show a typical application of the second extraction ground anchor 10", which would be quite similar to application of the first extraction ground anchor 10'. In FIG. 6, a hand 72 of a user swings a hammer 74 to impact the drive rod 38 forcing the ground anchor 10" underground 42 into an insertion position, which, as shown in FIG. 6, is generally coaxial with a direction of movement of the drive rod 38 which direction is represented by the directional arrows labeled "A" in FIG. 6. In FIG. 7, the ground anchor 10" is shown being moved from the insertion position of FIG. 6 into an anchor position by movement of the anchor cable 56" away from the surface of the ground 44 so that the anchor 10 is approximately transverse or perpendicular to the direction of movement of the drive rod 38 shown in FIG. 6. In FIG. 8, the grab loop section 54 of the extraction cable 50 is moved upward, away from the surface of the ground 44 to position the ground anchor 10" back in the insertion position, and as is apparent, further movement of the extraction cable 50 away from the ground will facilitate extraction of the anchor 10" from underground 42.

The ground anchor 10 of the present invention can therefore be seen as an efficient, durable, effective anchor that can be made of a single piece of metal. Preferred fabrication materials include stainless steels and related metals and alloys selected for anticipated strength requirements for the ground anchor, corrosion resistance necessary, anticipated duration of usage, and any need for re-use.

While the present invention has been described and illustrated with respect to a particular construction of the ground anchor 10 and the first and second extraction ground anchors 10', 10", it should be understood that the present invention is not limited to the described and illustrated examples. For example, while the anchor cable mount 28 is shown in FIGS. 2–4 in a preferred formation as a curved or punched out extension of the body 12 to define the mount slot 30, any standard cable mount that enables the anchor cable to be secured to the body 12 of the anchor 10 about midway between the guide and drive ends to thereby facilitate movement of the anchor 10 from the insertion position to the anchor position is within the scope of the invention. For example, a mere hole or throughbore would serve a similar purpose, but would not work as well as the described anchor cable mount 28. Additionally, it is pointed out that using the guide bore 34 in the curled tip 20 of the drive end 18 combined with the drive rod slot 36 of the body 12 for proper alignment of the ground anchor 10 during insertion facilitates usage of a variety of drive rod 38 structures provided the rod is adequately narrow to rest in he drive rod slot and includes a pointed drive end 76 (shown in FIG. 4) dimensioned to engage but not pass through the guide bore 34. For example, if a drive rod tool were to be misplaced, a user may simply cut, chop or otherwise form a wooden drive rod from common handles or other wooden structures, or use common metal rods with appropriately dimensioned drive ends, thereby avoiding much of the cost and complexity of known specialized drive rods for known complex prior art ground anchors. Unlike any known prior art ground anchors, having the drive rod 38 partially pass through the guide bore 34 significantly enhances insertion of the ground anchor 10 under ground. For example, if the curled tip 20 impacts a rock, root or other physical barrier during insertion under ground, the guide bore 34 will restrict the drive rod 38 from moving out of the curled tip 20, and the ground anchor will slide around the physical barrier, and continue into the ground. Accordingly, reference should be made primarily to the attached claims rather than to foregoing description to determine the scope of the invention.

What is claimed is:

1. A ground anchor for securing an anchor cable to the ground, comprising:

a. a body having a cable mount surface and an opposed drive rod surface, a drive end defining a curled tip and a guide end opposed to the drive end defining first and second guide forks, and an anchor cable mount projecting from the cable mount surface about midway between the drive and guide ends; and, b. wherein the curled tip defines a guide bore, the first and second guide forks define a drive rod slot, the curled tip and guide forks extend from the drive surface in a first direction so that a drive rod may pass through the drive rod slot into the guide bore, and the anchor cable mount extends away from the cable mount surface in a second direction opposed to the first direction so that the cable mount does not interfere with the drive rod passing through the drive rod slot and guide bore.

2. The ground anchor of claim 1, further comprising a drive extraction cable mount secured to the drive end of the body dimensioned to receive an extraction cable.

3. The ground anchor of claim 2, in combination with an extraction cable secured to the drive extraction cable mount, the extraction cable including a grab loop at an end of the cable opposed to an end of the extraction cable secured to the end extraction cable mount.

4. The ground anchor of claim 3, further comprising an anchor cable secured to the anchor cable mount and joined to the extraction cable.

5. The ground anchor of claim 1, further comprising a guide extraction cable mount secured to the guide end of the body dimensioned to receive an extraction cable.

6. The ground anchor of claim 5, in combination with an extraction cable secured to the guide extraction cable mount, the extraction cable including a grab loop at an end of the cable opposed to an end of the extraction cable secured to the guide extraction cable mount.

7. The ground anchor of claim 6, further comprising an anchor cable secured to the anchor cable mount and joined to the extraction cable.

8. The ground anchor of claim 1, wherein the anchor cable mount comprises a curved extension of the body defining a mount slot dimensioned to receive an anchor cable.

9. A ground anchor for securing an anchor cable to the ground, comprising:

a. a body having a cable mount surface and an opposed drive rod surface, a drive end defining a curled tip and a guide end opposed to the drive end defining first and second guide forks, an anchor cable mount defined in the cable mount surface about midway between the drive and guide ends, and extraction cable mount means for securing an extraction cable to the ground anchor; and, b. wherein the curled tip defines a guide bore, the first and second guide forks define a drive rod slot, the curled tip and guide forks extend from the drive surface in the same direction so that a drive rod may pass through the drive rod slot into the guide bore unimpeded by the anchor cable mount.

10. The ground anchor of claim 9, wherein the extraction cable mount means comprises a drive extraction cable mount defined in the drive end of the body dimensioned to receive an extraction cable.

11. The ground anchor of claim 9, wherein the extraction cable mount means comprises a guide extraction cable mount defined in the guide end of the body dimensioned to receive an extraction cable.

12. The ground anchor of claim 9, in combination with an anchor cable secured to the anchor cable mount and an extraction cable secured to the extraction cable mount means and joined to the anchor cable.

13. The ground anchor of claim 9, in combination with an extraction cable secured to the extraction cable mount means, the extraction cable including a grab loop at an end of the cable opposed to an end of the extraction cable secured to the extraction cable mount means.

14. The ground anchor of claim 9, wherein the anchor cable mount comprises a curved extension of the body defining a mount slot dimensioned to receive the anchor cable.

* * * * *